US006338676B1

(12) United States Patent
Kondou et al.

(10) Patent No.: US 6,338,676 B1
(45) Date of Patent: Jan. 15, 2002

(54) AIR CONDITIONER

(75) Inventors: Masakazu Kondou; Jun Kitamura; Takahiro Murayama; Motoo Sano; Shinichi Suzuki; Hiroaki Ishikawa; Akira Takamori; Hiroshi Fukazawa, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/471,473

(22) Filed: Dec. 23, 1999

(30) Foreign Application Priority Data

Dec. 28, 1998 (JP) ..... 10-373853
Apr. 2, 1999 (JP) ..... 11-096365

(51) Int. Cl.[7] ..... F24F 1/02
(52) U.S. Cl. ..... 454/315; 454/319; 454/321
(58) Field of Search ..... 454/299, 312, 454/314, 315, 319, 320, 321

(56) References Cited

U.S. PATENT DOCUMENTS 4,664,022 A * 5/1987 Oddenino ..... 454/155
4,712,611 A 12/1987 Witzel
5,194,049 A 3/1993 Takahashi et al.
5,396,783 A 3/1995 Park
5,924,923 A 7/1999 Chiguchi et al.

FOREIGN PATENT DOCUMENTS

| | | |
|---|---|---|
| EP | 0 774 628 | 5/1997 |
| EP | 0 962 716 | 12/1999 |
| JP | 62-56721 | * 3/1987 |
| JP | 62-84233 | 4/1987 |
| JP | 62-158930 | * 7/1987 |
| JP | 2-157540 | * 6/1990 |
| JP | 2-157541 | * 6/1990 |
| JP | 6-313573 | 11/1994 |
| JP | 8-189661 | 7/1996 |
| JP | 10-246499 | 9/1998 |

* cited by examiner

*Primary Examiner*—Harold Joyce
(74) *Attorney, Agent, or Firm*—Oblon, Spivak, McClelland, Maier & Neustadt, P.C.

(57) ABSTRACT

Inside a blown-out air duct in the air conditioner through which conditioned air reaches a blowing-out port, there is provided a rectifying box having a air passage therein, for rectifying a flow of the conditioned air toward a predetermined flowing direction in order to prevent any dew condensation at the blowing-out port in the air conditioner. In the meantime, in order to suppress noise, rectifying plates for reducing an inflowing angle of air flowing into the fin tips of a heat exchanger are interposed between an axial fan and the heat exchanger for taking in the air from the axial fan for heat exchanging.

12 Claims, 15 Drawing Sheets

FIG. 8
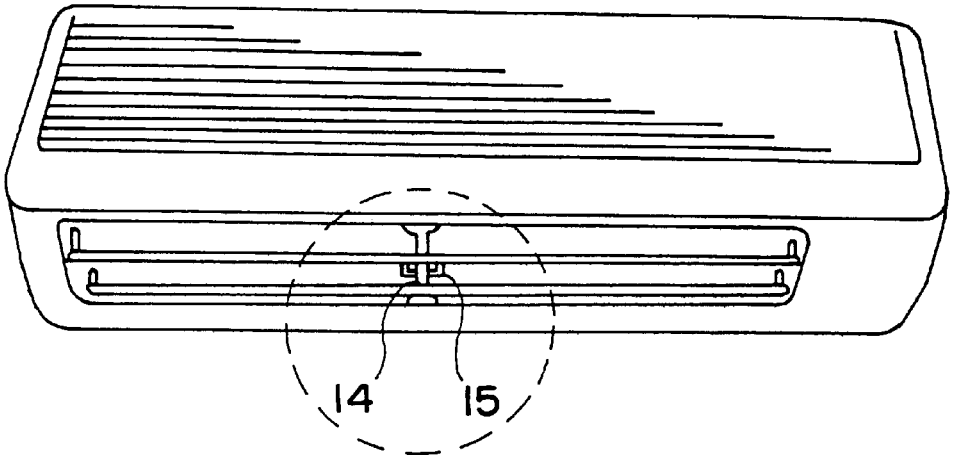
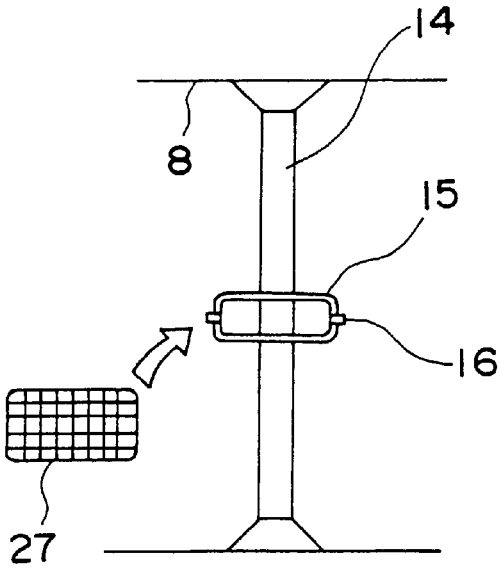
FIG. 8A
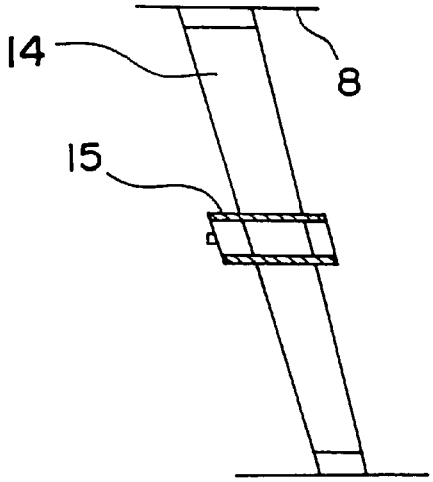
FIG. 8B

AIR CONDITIONER

BACKGROUND OF THE INVENTION

1. Field of the Invention

The present invention relates to an air conditioner and, more particularly, to rectification of an airflow in an air conditioner.

2. Description of the Prior Art

As shown in FIG. 9 which is a cross-sectional view showing an air conditioner, when conditioned air whose temperature is conditioned by an air conditioner is blown out of a blowing-out port 19, a pressure loss generally occurs in the blown-out air passing through a blown-out air duct reaching the blowing-out port 19 by the influence of vertical air flowing direction adjusting vanes 4 or lateral air flowing direction adjusting vanes 21. Furthermore, if a rotating speed of a cross-flow fan 22 having a function of generating the blown-out air of the conditioned air decreases, the blown-out air becomes turbulent or a quantity of the blown-out air is reduced. This prevents the blown-out air from flowing along the vertical air flowing direction adjusting vanes 4 positioned in front of the cross-flow fan 22 so as to separate the blown-out air from the vanes 4, thereby causing dew condensation. In order to alleviate or prevent such a phenomenon, a jumper mount 1 shown in a cross-sectional view of FIG. 10 or a baffle plate 2 shown in a cross-sectional view of FIG. 11 has been conventionally fixed in the structure of the blowing-out port.

A purpose of the jumper mount 1 is to blown out air along the vertical vanes 4 by changing a main stream advancing direction of the blown-out air flowing along a casing of a unit box 3 defining a back wall of the blown-out air duct, thereby reducing the contact of the vertical vanes 4 cooled by the blown-out air with outside air so as to prevent any dew condensation. Another purpose is to direct the main stream advancing direction of the blown-out air in a certain direction so as to suppress turbulence, so that dew condensation in the vicinity of the blowing-out port 19 caused by the turbulence due to a decrease of air quantity which is caused by reducing the rotating speed of the cross-flow fan 22 for generating the blown-out air.

However, since the jumper mount 1 is brought into direct contact with the blown-out air, it is cooled by the air, so that dew condensation occurs at an end face 5 of the jumper mount 1 which is in contact with the outside air. Consequently, it is necessary to attach a member having a water retaining property such as a flocked tape to the end face 5.

In the meantime, the baffle plate 2 reduces the blowing-out area of the blowing-out port 19 so as to partly increase an air quantity and allow the blown-out air to further flow over a portion of the vertical vane 4 where dew condensation occurs. Similarly to the jumper mount 1 for reducing separation of the blown-out air, the baffle plate 2 is the technique for reducing the dew condensation.

However, since the baffle plate 2 increases the blown-out air 18 but decreases the blown-out air 17, as shown in FIG. 11, the outside air flows into the structure of the blowing-out port from the upper part of the port where the blown-out air 17 is decreased. Accordingly, since the baffle plate 2 in direct contact with the blown-out air is cooled in the air, dew condensation at an end face 6 of the baffle plate 2 is caused. Therefore, also in this case, it is necessary to attach a member having a water retaining property such as a flocked tape to the end face 6, like in the case of the jumper mount 1.

In this way, although the prior art can resultantly reduce or prevent the phenomenon of the dew condensation with respect to the blowing-out port in the air conditioner, the dew condensation occurs at other portions in turn, so that it is necessary to attach a member having a water retaining property such as a flocked tape or to additionally attach other parts known as prior arts, thus raising the problem of an increase in the number of component parts.

In the meanwhile, FIG. 19 is a side cross-sectional view showing a conventional window type air conditioner which is installed on a wall. In FIG. 19, reference numeral 31 designates a casing of the air conditioner, the inside of which is divided into an exterior side and an interior side by a partition plate 32; 33, an exterior suction port through which exterior air is sucked from the exterior of a room; 34, an exterior blowing-out port, through which air is blown out to the exterior of the room; 35, an interior suction port, through which interior air is sucked from the interior of the room; 36, an interior blowing-out port, through which air is blown out to the interior of the room; 37, an exterior heat exchanger disposed in the vicinity of the exterior blowing-out port 34 inside the casing 31; 38, an interior heat exchanger disposed in the vicinity of the interior suction port 35 inside the casing 31; 39, an electric motor for blowing, disposed on the exterior side; 40, an axial fan interposed between the exterior heat exchanger 37 and the electric motor 39 and connected to the electric motor 39; 40*a*, a blade fixing portion (i.e., a boss), to which a blade of the axial fan 40 is fixed; 41, a sirocco fan interposed between the interior heat exchanger 38 and the electric motor 39 and connected to the electric motor 39; 42, a fan cover disposed around the axial fan 40; and 43, a compressor constituting a refrigerant cycle together with the exterior heat exchanger 37 and the interior heat exchanger 38.

In the air conditioner such constituted as described above, the electric motor 39 drives to rotate the axial fan 40 on the exterior side, so as to suck the exterior air through the exterior suction port 33. The exterior air is sucked into the axial fan 40, and then, is blown out of the exterior blowing-out port 34 through the exterior heat exchanger 37.

Moreover, the electric motor 39 drives to rotate the sirocco fan 41 on the interior side, so as to suck the interior air through the interior suction port 35. The interior air is sucked into the sirocco fan 41 through the interior heat exchanger 38, and then, is blown out of the interior blowing-out port 36.

In the conventional air conditioner such constituted as described above, the exterior heat exchanger 37 is greater in size than the outer diameter of the axial fan 40, and further, the exterior heat exchanger 37 and the axial fan 40 are arranged in close proximity to each other. Consequently, inflowing air at the fin tips of the exterior heat exchanger 37 placed apart from the outer diameter of the axial fan 40 flows as illustrated in FIG. 20. That is, an angle θ between the fin and the inflowing airflow is large, thus raising the problems that the inflowing air is liable to be separated from the fins and noise is likely to occur.

Additionally, since no air flows at the rear end 50 of the boss 40*a* of the axial fan 40, the inflowing air flows into the fin tips facing the boss 40*a* with a large inflowing angle, thereby raising problems similar to those described above.

SUMMARY OF THE INVENTION

The present invention has been accomplished in an attempt to solve the above problems observed in the prior art. An object of the present invention is to provide an air conditioner in which an airflow inside the air conditioner is rectified with simple configuration, thus maintaining blowing performance and preventing dew condensation or suppressing noise.

According to the present invention, an air conditioner having an air duct through which temperature-conditioned air reaches a blowing-out port, comprises a rectifying mechanism having a blown-out air passage therein, for rectifying a flow of the conditioned air toward a predetermined flowing direction. Thus, it is possible to produce the effect of rectifying air with simple configuration while maintaining the blowing performance.

The rectifying mechanism may supply the conditioned air in a predetermined quantity or more to a wall surface defining the air duct. Consequently, it is possible to produce the effect of preventing any dew condensation caused by a back-flow of interior air from the blowing-out port.

The rectifying mechanism may be provided with an air quantity adjusting member for adjusting an air quantity passing through the air passage. Therefore, it is possible to produce the effect of appropriately adjusting a quantity of air to be rectified by the rectifying mechanism.

A member constituting the air passage of the rectifying mechanism may be juxtaposed with a main stream of blown-out air. Thus, it is possible to produce the effect of preventing the rectifying mechanism from causing another air resistance or turbulence, and further, the effect of smooth rectifying without causing any dew condensation.

The rectifying mechanism may be disposed at a position at which blown-out air inside the air duct is deflected toward a different direction. Consequently, it is possible to produce the effect of preventing any generation of turbulence caused by deflection or any occurrence of dew condensation.

The rectifying mechanism may be disposed in a guide vane base serving as the structure for fixing a lateral air flowing direction adjusting vanes, which are disposed in the air duct to laterally adjust the direction of blown-out air. Therefore, it is possible to produce the effect of rectifying without installing any additional dew condensation preventing structure for the rectifying mechanism.

The rectifying mechanism may be disposed in a unit box for a fan for producing blown-out air. Thus, it is possible to produce the effect of preventing any generation of turbulence or dew condensation caused by separation of the blown-out air from the unit box and rectifying the air without installing any additional dew condensation preventing structure for the rectifying mechanism.

The rectifying mechanism may be disposed in the vicinity of the portion where a plurality of air flowing direction adjusting pieces for adjusting the direction of blown-out air are oriented in directions different from each other. Consequently, it is possible to produce the effect of preventing any generation of turbulence around the boundary of different air flowing directions in the case where the air is blown in the different directions.

The rectifying mechanism may be molded integrally with any one of component parts constituting the air conditioner. Therefore, it is possible to produce the effect of forming the rectifying mechanism without inducing any increase in the number of component parts.

Furthermore, according to the present invention, an air conditioner including an axial fan for blowing air and a heat exchanger having cooling fins for taking in the air blown by the axial fan so as to perform heat exchanging, comprises rectifying means interposed between the axial fan and the heat exchanger, for reducing an inflowing angle of air flowing into the fin tips of the heat exchanger. Thus, it is possible to reduce the angle between fins of the heat exchanger and the flow of the inflowing air so as to hardly separate the inflowing air from the fins, thereby suppressing occurrence of noise.

The rectifying means may be attached to the heat exchanger. Consequently, the air conditioner can be easily assembled after the rectifying means is attached.

The rectifying means may be fixed to a portion except the heat exchanger. Therefore, assembling workability can be enhanced more than the case where the rectifying means is attached to the heat exchanger.

The rectifying means may be disposed at a portion except a projection area of the axial fan onto the heat exchanger. Thus, it is possible to reduce the angle between the fin and the flow of the inflowing air at the portion except the projection area of the axial fan onto the heat exchanger so as to hardly separate the inflowing air from the fins, thereby suppressing occurrence of noise.

The axial fan may include a blade fixing portion for fixing a blade at substantially the center thereof, and the rectifying means may be disposed within a projection area of the blade fixing portion onto the heat exchanger. Therefore, it is possible to suppress an increase of an inflowing angle of the inflowing air at the fin tips facing the blade fixing portion, which is caused by no airflow at the rear end of the blade fixing portion, and to reduce noise because of less separation of the air.

The rectifying means may be constituted of a flat rectifying plate. Consequently, it is possible to manufacture the rectifying means at a reduced cost.

The rectifying means may be constituted of a rectifying plate inclined on the suction side thereof toward the axial fan. Therefore, it is possible to reduce the inflowing angle of the air flowing into the fin tips of the heat exchanger so as to enhance the effect of suppressing noise.

In an air conditioner including an axial fan for blowing air and a heat exchanger having cooling fins for taking in the air blown by the axial fan so as to perform heat exchanging, the fins are inclined on the suction side thereof toward the axial fan. Thus, it is possible to reduce the angle between the fins of the heat exchanger and the inflowing airflow so as to hardly separate the inflowing air from the fins, thereby suppressing occurrence of noise, and to dispense with another rectifying means so as to reduce the number of component parts. Additionally, it is possible to eliminate detaching work of the rectifying means at the time of recycling, and further, the fins are excellent in recycling property since the fins are made of aluminum.

The fins may be inclined on the suction side thereof toward the axial fan at a portion except a projection area of the axial fan onto the heat exchanger. Thus, it is possible to reduce the angle between the fins and the inflowing airflow at the portion except the projection area of the axial fan so as to hardly separate the inflowing air, thereby suppressing occurrence of noise.

The axial fan may include a blade fixing portion for fixing a blade at substantially the center thereof, and the fins may be inclined on the suction side thereof toward the blade within a projection area of the blade fixing portion onto the heat exchanger. Therefore, it is possible to suppress an increase in inflowing angle of the inflowing air at the fin tips facing the blade fixing portion, which is caused by no airflow at the rear end of the blade fixing portion, and to reduce noise because of less separation of the air.

BRIEF OF THE DRAWINGS

FIG. 8 is a front view and partly enlarged views showing the rectifying mechanism for the air conditioner in the third embodiment according to the present invention;

DESCRIPTION OF THE PREFERRED EMBODIMENTS

Figure 1:
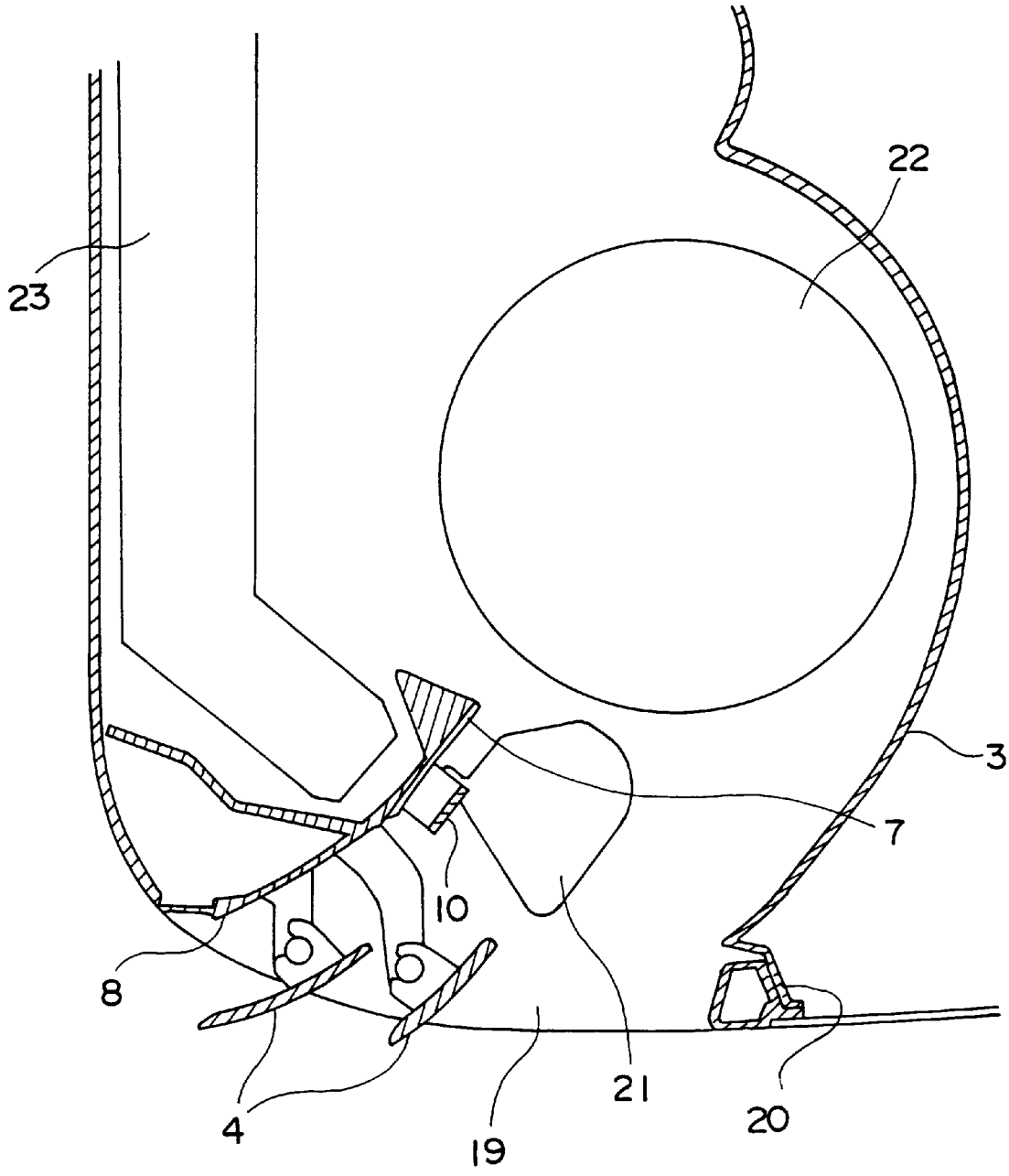
FIG. 1 is a cross-sectional view showing a rectifying mechanism for an air conditioner in a first embodiment according to the present invention.

Preferred embodiments of a rectifying mechanism for an air conditioner according to the present invention will be explained below in detail in reference to the attached drawings. Throughout the preferred embodiments explained hereunder, component parts like or corresponding to those of the air conditioner in the prior art are denoted by the same reference numerals, and the description thereof will be omitted to avoid duplication.

First Embodiment

Figure 2:
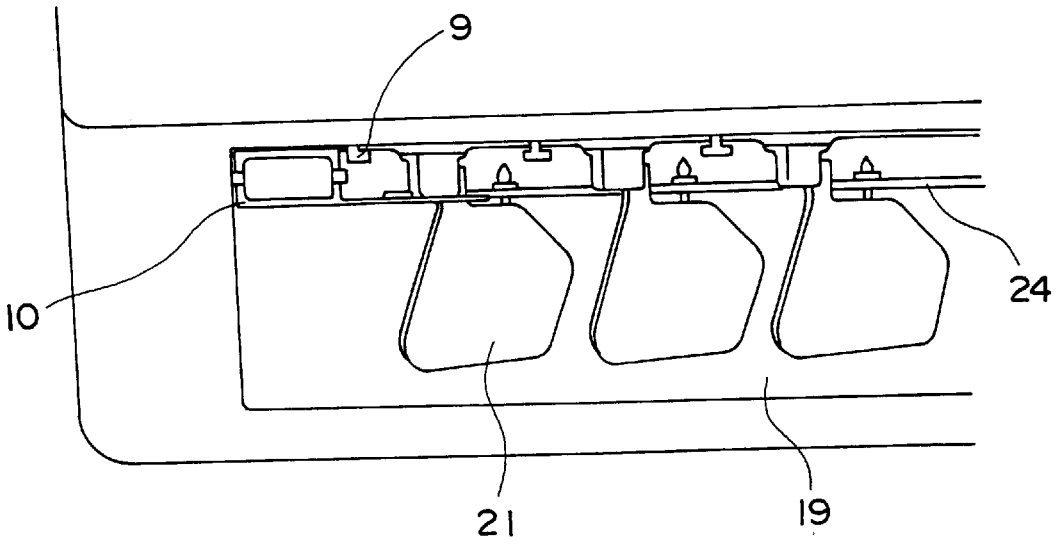
FIG. 2 is an enlarged front view showing the rectifying mechanism for the air conditioner in the first embodiment according to the present invention.
Figure 3:
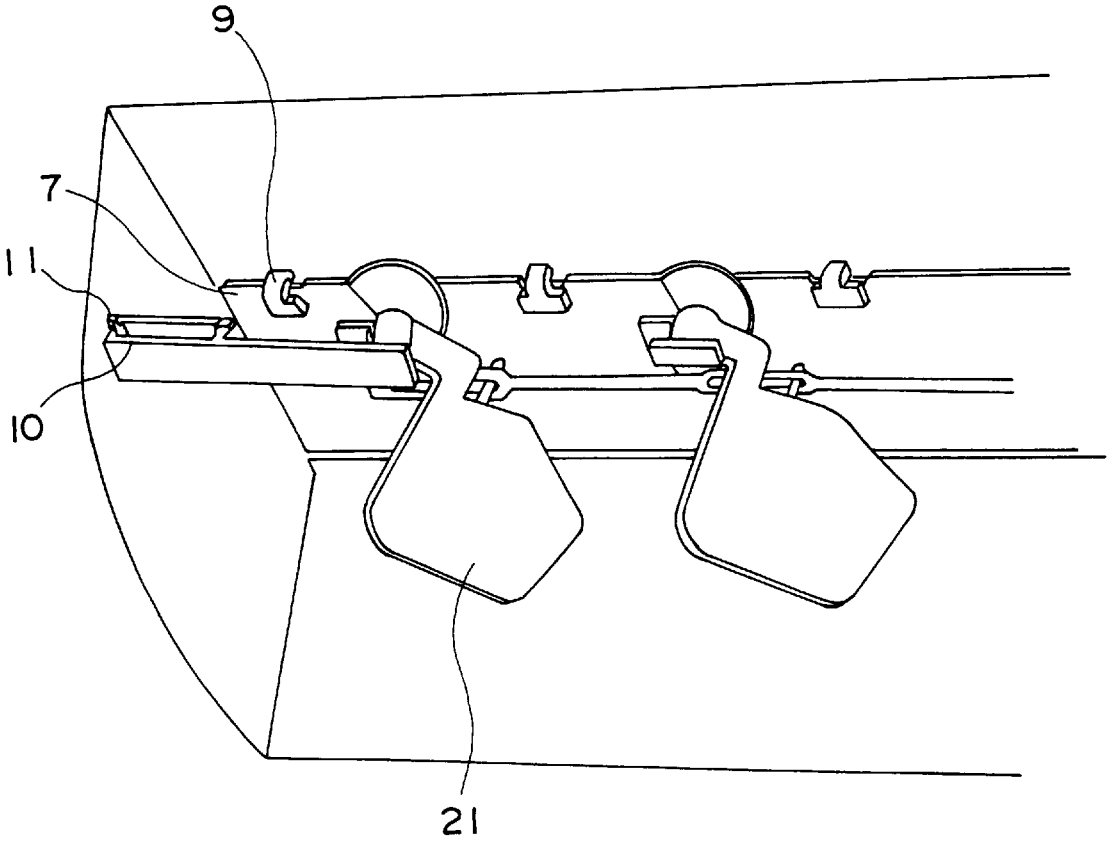
FIG. 3 is an enlarged perspective view showing the rectifying mechanism for the air conditioner in the first embodiment according to the present invention.
Figure 4:
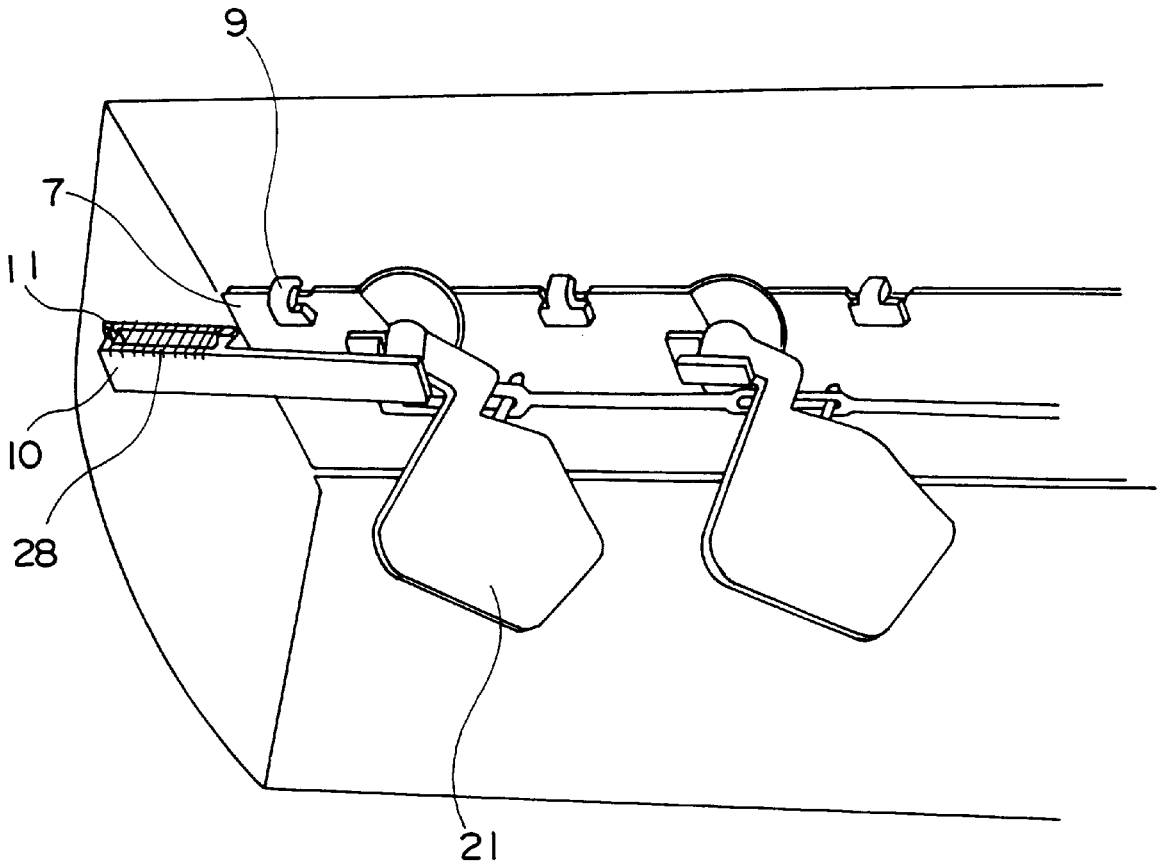
FIG. 4 is an enlarged perspective view showing an air quantity adjusting member fixed to the rectifying mechanism for the air conditioner in the first embodiment according to the present invention.

FIG. 1 is a cross-sectional view showing a dew condensation preventing mechanism for vertical air flowing direction adjusting vanes positioned at a blowing-out port in an air conditioner according to the present invention; FIG. 2 is an enlarged front view of FIG. 1; FIG. 3 is an enlarged perspective view of FIG. 1; and FIG. 4 illustrates one example in which an air quantity adjusting member is fixed to the mechanism shown in FIG. 3. In FIGS. 1 to 4, reference numeral 23 designates a heat exchanger for performing heat exchange between interior air to be sucked from the interior of a room and a refrigerant by a refrigeration cycle, not shown, so as to perform cooling or warming; 19, a blowing-out port, through which air conditioned by the heat exchanger 23 is blown into the interior, and which is defined by a nozzle upper frame constituting member 8 fixed to a unit box 3 of an air conditioner body (an interior unit) and a lower wall 20 of the unit box 3; and 22, a fan for producing an airflow from the interior to the blowing-out port 19 via the heat exchanger 23, the fan being of a cross-flow type in this embodiment.

Reference numeral 7 denotes a guide vane base made of a synthetic resin, fixed to the nozzle upper frame constituting member 8 via fixing portions 9; 10, a rectifying box having a hollow structure, integrally molded at right and left ends of the guide vane base 7 in such a manner that the constituent member thereof is juxtaposed with respect to the main stream of blown-out air in order to minimize a pressure loss of the blown-out air. An air duct from the cross-flow fan 22 toward the blowing-out port 19, defined by the unit box 3 constitutes a blown-out air duct, through which the conditioned air heat-exchanged by the heat exchanger 23 passes. The rectifying box 10 corresponds to the rectifying mechanism.

Lateral air flowing direction adjusting vanes 21 are attached at predetermined intervals to the guide vane base 7, are connected to each other via connecting members 24, and are driven to be swung in the lateral direction by a motor, not shown. The rectifying box 10 is disposed in the vicinity of an air duct side wall and between an outermost lateral air flowing direction adjusting vane 21 and the air duct side wall, where a flowing quantity of the conditioned air is reduced depending upon the orientation of the lateral adjusting vanes 21.

A fixing portion 11 for fixing a mesh-like air quantity adjusting member for adjusting the quantity of the blown-out air passing through the inside of the hollow structure of the rectifying box 10 is molded integrally with the rectifying box 10. FIG. 4 is a perspective view illustrating the state in which the air quantity adjusting member is fixed. In FIG. 4, reference numeral 28 designates the mesh-like air quantity adjusting member for generating a predetermined passing resistance. The air quantity adjusting member 28 may be fixed upstream or downstream of the rectifying box 10 for producing the same effect, although it is fixed downstream in this embodiment. The passing resistance of the air quantity adjusting member 28 can be varied by changing the fineness of its mesh, and therefore, a mesh capable of generating an adequate passing resistance may be selectively fixed, as required.

Subsequently, operation will be explained below. For example, in the case where the lateral adjusting vanes 21 are directed to the left, the flow of the conditioned air is reduced on the right side of the blowing-out port 19, and therefore, the interior air flows in from the blowing-out port 19, so that dew condensation is liable to occur. However, with the configuration in the present embodiment, the conditioned air flows inside the rectifying box 10 in a constant air quality not affected by the direction of the lateral adjusting vanes 21, by the effect of the rectifying box 10 disposed on the right side of the blown-out air duct. Since the air securely flows along the wall surface of the blown-out air duct, it is possible to prevent any inflow of the interior air from the blowing-out port 19 side in the blown-out air duct or any generation of turbulence caused by the inflow, thereby preventing any occurrence of dew condensation.

In the present embodiment, since the rectifying box 10 is resin-molded integrally with the guide vane base 7, it is possible to reduce the number of component parts of the rectifying mechanism for rectifying the blown-out air. Furthermore, since the rectifying box 10 is positioned in the blown-out air and brought into contact with no outside air, no dew is condensed at the rectifying box 10. Consequently, it is possible to dispense with a special dew condensation preventing structure such as a flocked tape in the prior art so as to prevent any increase in the number of component parts. As a result, the rectifying box 10 has the advantages of eliminating a part having a water retaining property such as a flocked tape which has been required in the prior art, so as to reduce the number of component parts, and further, of saving the trouble to detach a flocked tape from the rectifying mechanism at the time of disassembling process in recycling or the like.

Second Embodiment

Figure 5:
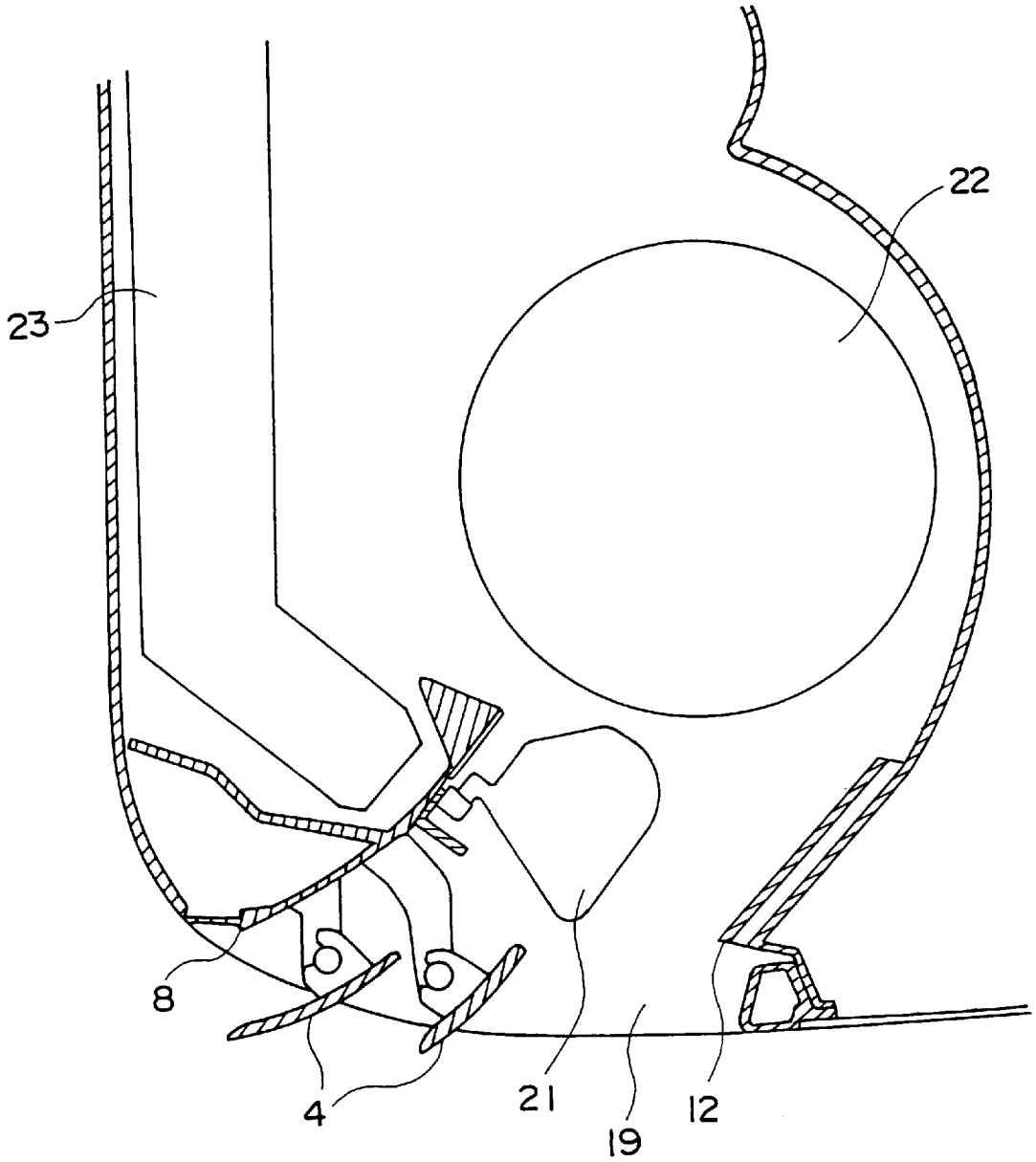
FIG. 5 is a cross-sectional view showing a rectifying mechanism for an air conditioner in a second embodiment according to the present invention.
Figure 6:
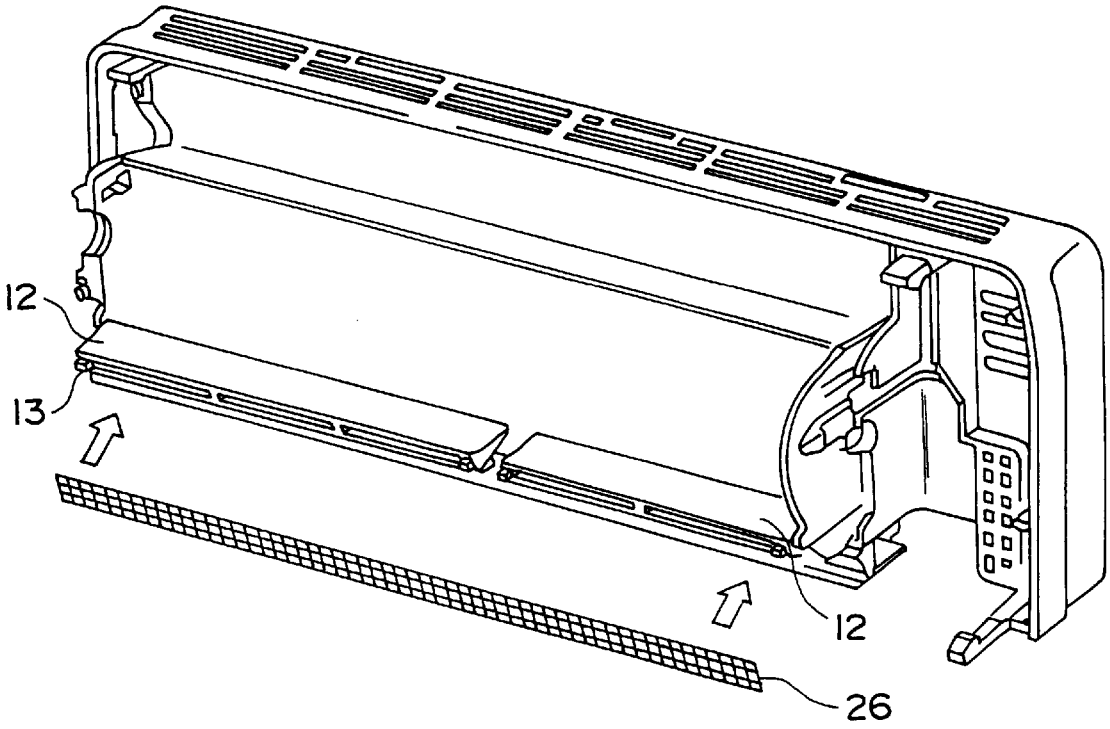
FIG. 6 is a perspective view showing the rectifying mechanism for the air conditioner in the second embodiment according to the present invention.

FIG. 5 is a cross-sectional view showing a dew condensation preventing structure for vertical air flowing direction adjusting vanes positioned at a blowing-out port in the air conditioner according to the present invention; and FIG. 6 is a perspective view of FIG. 5. In FIG. 5, component parts like or corresponding to those of the air conditioner shown in FIGS. 1 to 3 are denoted by the same reference numerals, and the description thereof will be omitted to avoid duplication. In FIGS. 5 and 6, reference numeral 12 designates a jumper mount box serving as a rectifying mechanism having a hollow structure, molded integrally with a unit box 3 constituting a back wall of a blown-out air duct of conditioned air; and 4, the vertical air flowing direction adjusting vanes driven by a motor, not shown, so as to be freely moved in a vertical direction.

The jumper mount box 12 having the hollow structure is present at a portion where a flow quantity of the conditioned air is reduced depending upon the positions of the vertical adjusting vanes 4, and blown-out air flows along the vertical adjusting vanes 4 located downstream of the blown-out air duct and in the vicinity of a blowing-out port 19, wherein the hollow structure is molded within such a range as to keep a necessary strength of the unit box 3.

A fixing portion 13 for fixing a mesh-like air quantity adjusting member 26 for adjusting an air quantity of the blown-out air passing through the inside of the hollow structure is molded integrally with the jumper mount box 12 having the hollow structure, in the same manner as in the first embodiment. The mesh-like air quantity adjusting member 26 for use in air quantity adjustment may be fixed upstream or downstream of the jumper mount box 12 for producing the same effect, although it is fixed upstream in this embodiment.

Subsequently, operation will be explained below. For example, in the case where the vertical adjusting vanes 4 are directed upward, the flow of the conditioned air is reduced on the lower side of the blowing-out port 19, and therefore, the interior air flows in from the blowing-out port 19, so that dew condensation is liable to occur. However, with the configuration in the present embodiment, the conditioned air flows inside the hollow structure of the jumper mount box 12 in a constant air quantity not affected by the direction of the vertical adjusting vanes 4, by the effect of the jumper mount box 12 disposed on the lower side of the blown-out air duct. Since this air securely flows along the back wall surface of the blown-out air duct, it is possible to prevent any inflow of the interior air from the blowing-out port 19 side in the blown-out air duct or any generation of turbulence caused by the inflow, thereby preventing any occurrence of dew condensation.

In this way, since the jumper mount box 12 having the hollow structure is formed into a hollow shape in a portion where dew has been condensed in the prior art, it is thus brought into contact with no outside air. Furthermore, since the area on the air duct is reduced, no dew is condensed at the jumper mount box 12 per se. Consequently, it is possible to prevent any increase in the number of additional component parts such as a flocked tape, which has been caused in the prior art.

Moreover, the jumper mount box 12 has the advantages of eliminating a part having a water retaining property such as a flocked tape which has been required in the prior art, so as to reduce the number of component parts, and further, of saving the trouble to detach a flocked tape from the rectifying mechanism at the time of disassembling process in recycling or the like.

Third Embodiment

Figure 7:
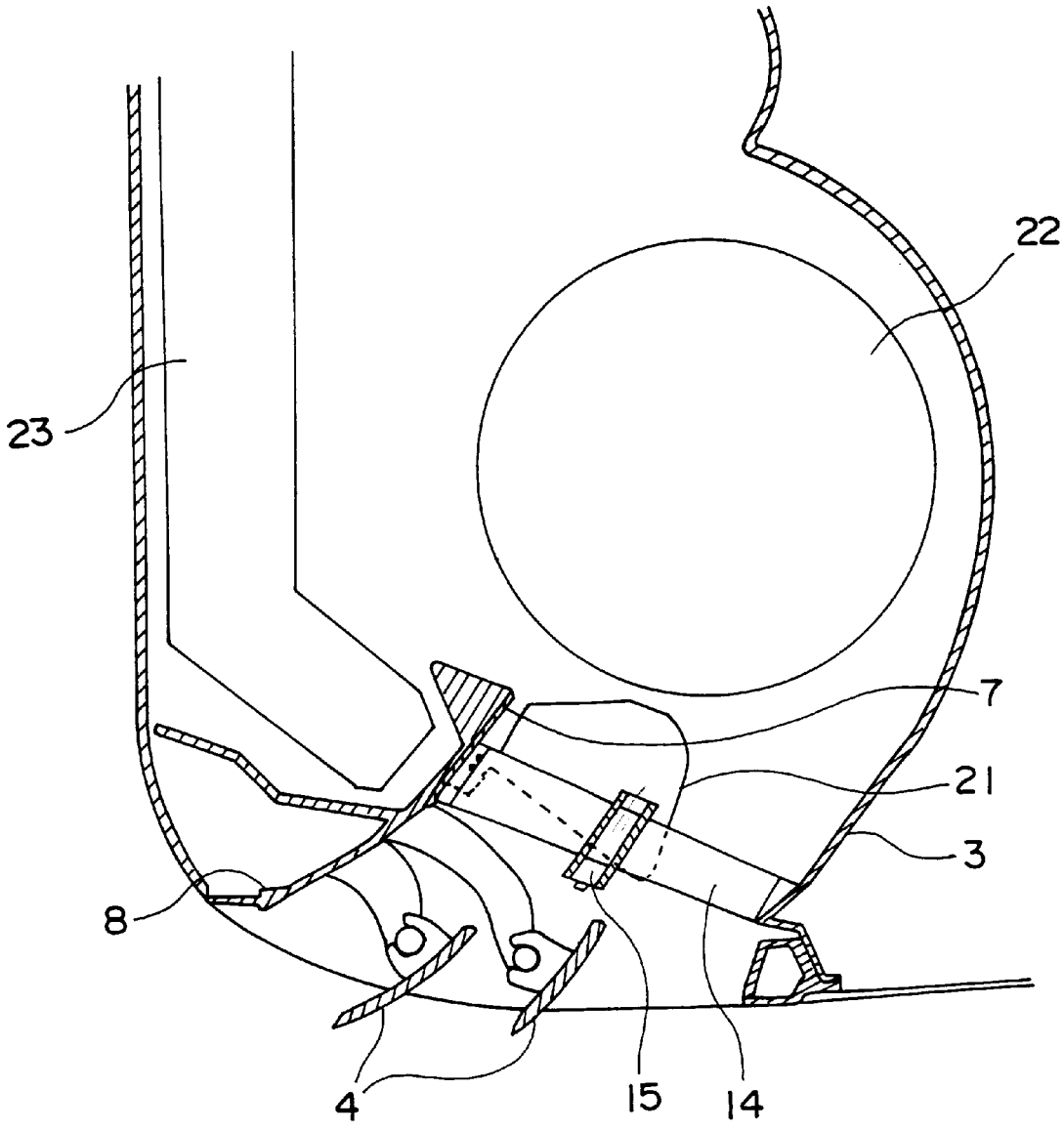
FIG. 7 is a cross-sectional view showing a rectifying mechanism for an air conditioner in a third embodiment according to the present invention.
Figure 9:
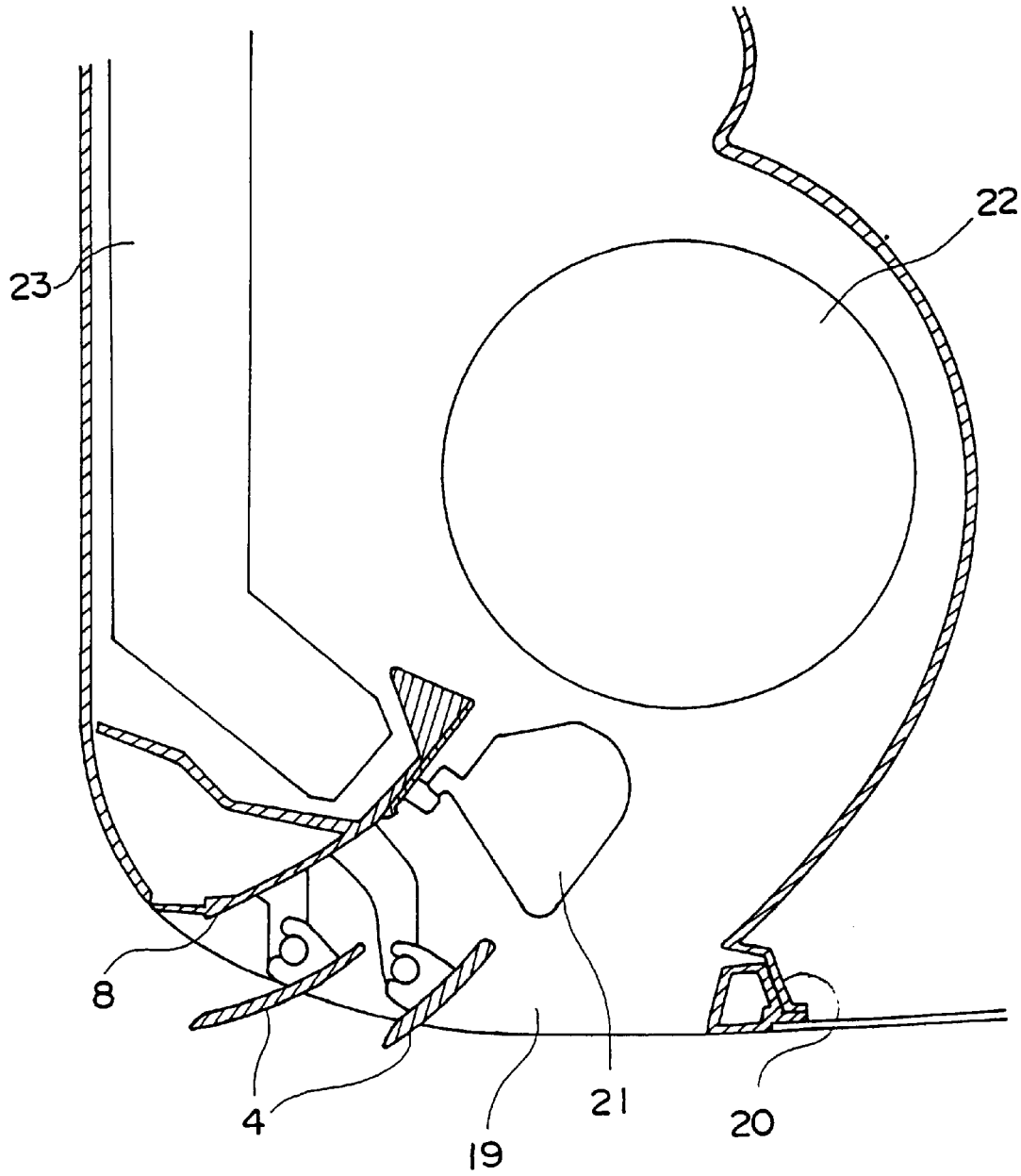
FIG. 9 PRIOR ART
FIG. 9 is a cross-sectional view showing a basic air conditioner in the prior art.
Figure 10:
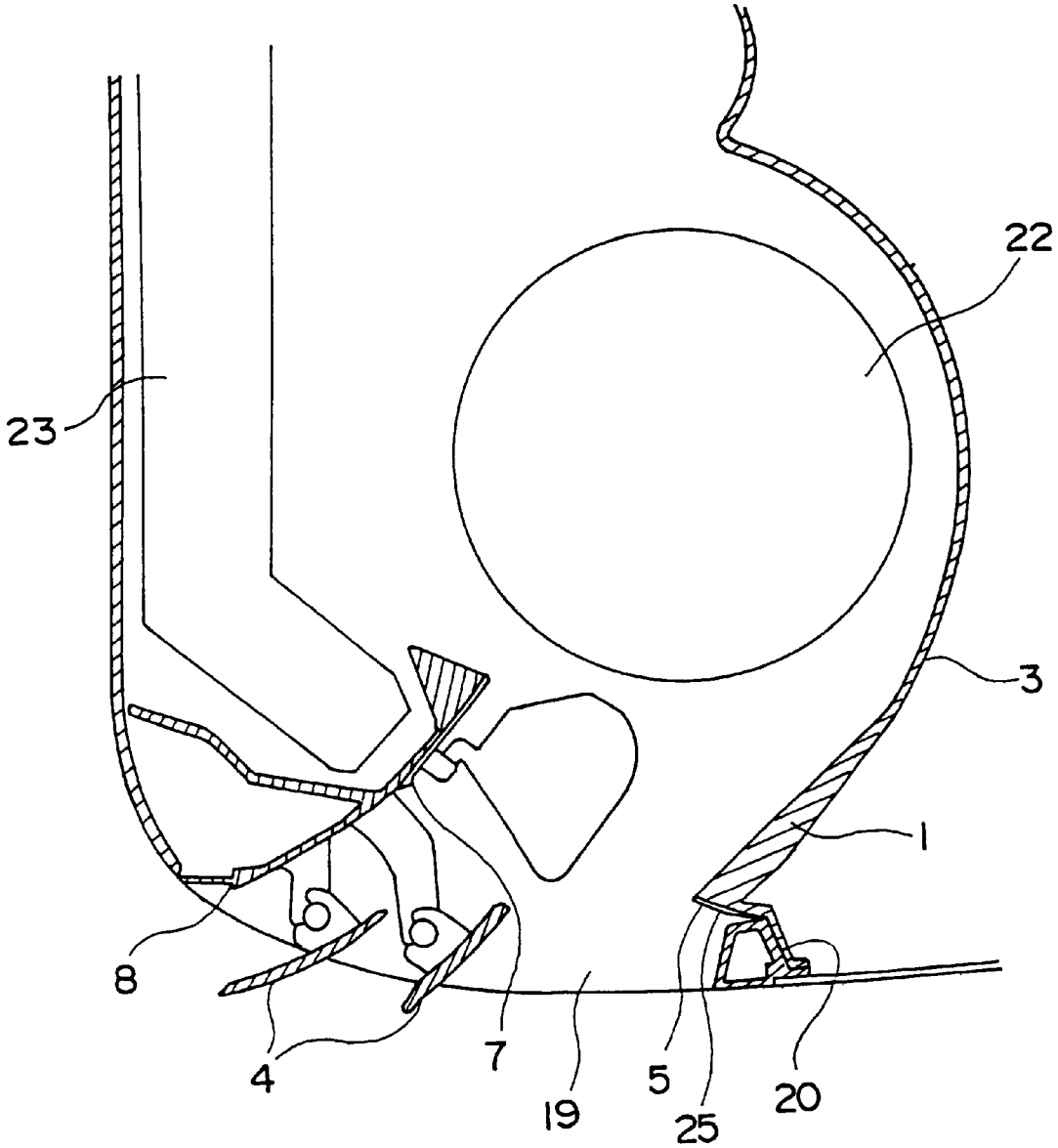
FIG. 10 PRIOR ART
FIG. 10 is a cross-sectional view showing a dew condensation preventing mechanism (by the use of a jumper mount) for preventing a dew condensation at a blowing-out port for the air conditioner in the prior art.
Figure 11:
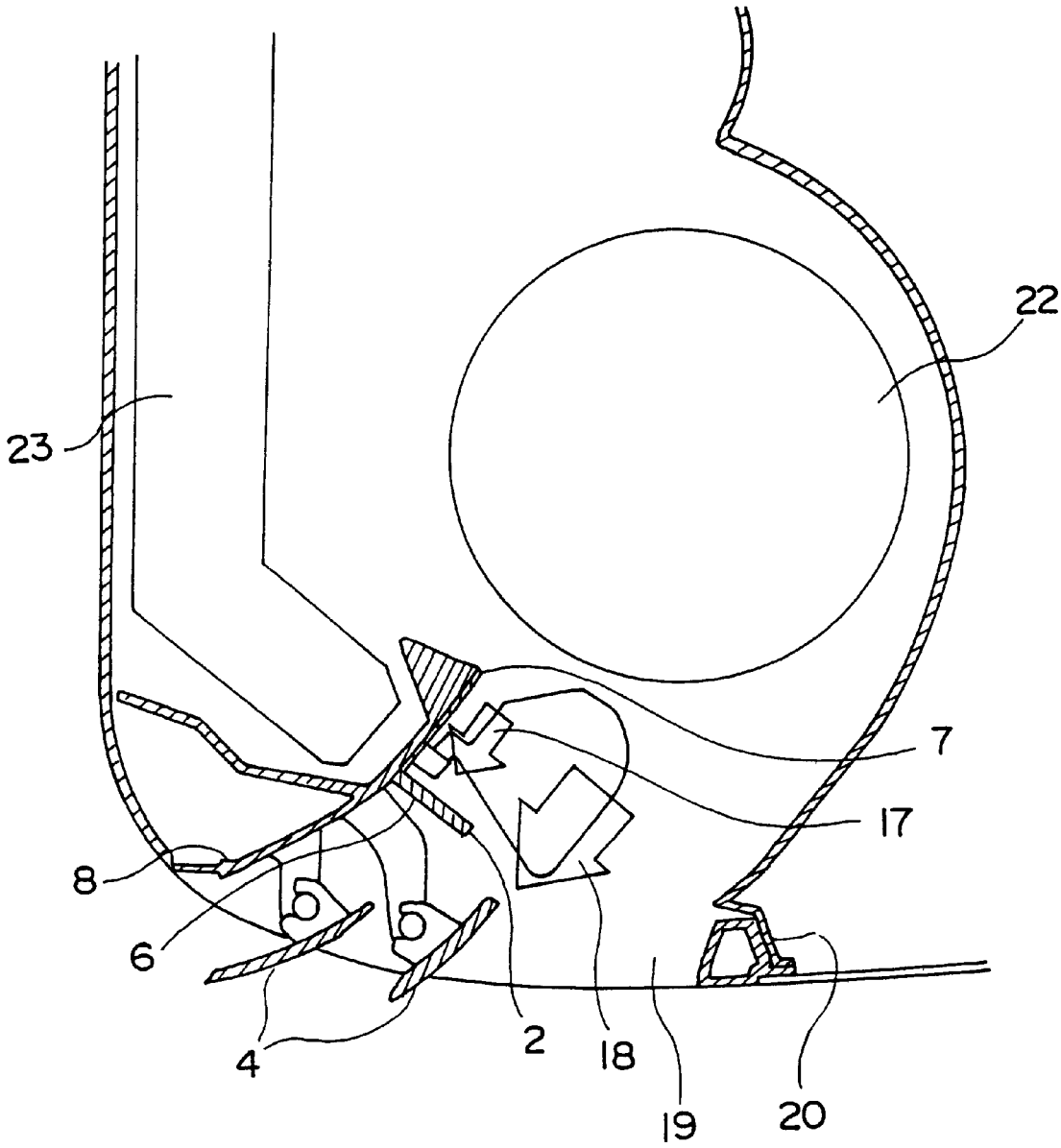
FIG. 11 PRIOR ART
FIG. 11 is a cross-sectional view showing another dew condensation preventing mechanism (by the use of a baffle plate) for preventing a dew condensation at the blowing-out port for the air conditioner in the prior art.

FIG. 7 is a cross-sectional view showing a dew condensation preventing structure of vertical air flowing direction adjusting vanes positioned at a blowing-out port in the air conditioner according to the present invention; and FIG. 8 is a conceptual view of FIG. 7. In FIGS. 7 and 8, component parts like or corresponding to those of the air conditioner shown in FIGS. 1 to 3 are denoted by the same reference numerals, and the description thereof will be omitted to avoid duplication. In FIGS. 7 and 8, reference numeral 14 designates a nozzle center supporter fixed to a nozzle upper frame constituting member 8 in order to position a central rectifying box 15, described later, inside a predetermined space of a blown-out air duct for conditioned air; and 15, the central rectifying box molded integrally with the nozzle center supporter 14, the central rectifying box 15 serving as a rectifying mechanism having a hollow structure penetrating in a flowing direction of the conditioned air inside the blown-out air duct.

The central rectifying box 15 is positioned in parallel to the main stream of the blown-out air in order to minimize a pressure loss of the blown-out air. Furthermore, the central rectifying box 15 is located at a portion at which turbulence is caused by different orientations of a plurality of lateral air flowing direction adjusting vanes 21 (in the present embodiment, at the center between right and left sides of the blown-out air duct).

Subsequently, operation will be explained below. For example, in the case where the lateral air flowing direction adjusting vanes 21 on the left side of the nozzle center supporter 14 are oriented leftward while the lateral air flowing direction adjusting vanes 21 on the right side of the nozzle center supporter 14 are oriented rightward, the flow of the conditioned air is reduced in the vicinity of the nozzle center supporter 14, and therefore, the interior air flows in from the blowing-out port 19, so that dew condensation is liable to occur. However, with the configuration in the present embodiment, the conditioned air flows inside the hollow structure of the central rectifying box 15 in a constant quantity not affected by the orientations of the lateral air flowing direction adjusting vanes 21, by the effect of the central rectifying box 15 disposed at the nozzle center supporter 14. Consequently, it is possible to prevent any inflow of the interior air from the blowing-out port 19 side in the blown-out air duct or any generation of turbulence caused by the inflow, thereby preventing any occurrence of dew condensation.

Furthermore, the central rectifying box 15 is positioned in the blown-out air, and therefore, is not brought into contact with any outside air. Consequently, no dew is never condensed at the central rectifying box 15 per se, thus preventing any increase in the number of component parts, which has been induced in the prior art.

A fixing portion 16 for fixing a mesh-like member 27 for adjusting the blown-out air passing through the inside of the hollow structure is molded integrally with the central rectifying box 15, in the same manner as in the first embodiment. The mesh-like air quantity adjusting member 27 for use in air quantity adjustment may be fixed upstream or downstream of rectifying box for producing the same effect, although it is fixed downstream in this embodiment.

The central rectifying box 15 is molded integrally with the nozzle upper frame constituting member 8, thereby preventing any increase in the number of component parts for rectifying the blown-out air in the vicinity of the center of the blowing-out port.

Moreover, the central rectifying box 15 has the advantages of eliminating a part having a water retaining property such as a flocked tape which has been required in the prior art, so as to reduce the number of component parts, and further, of saving the trouble to detach a flocked tape from the rectifying mechanism at the time of disassembling process in recycling or the like.

The above-described first to third embodiments may be carried out in combination thereof. For example, an air conditioner according to the present invention may be configured by combining all of the first to third embodiments.

Fourth Embodiment

Figure 12:
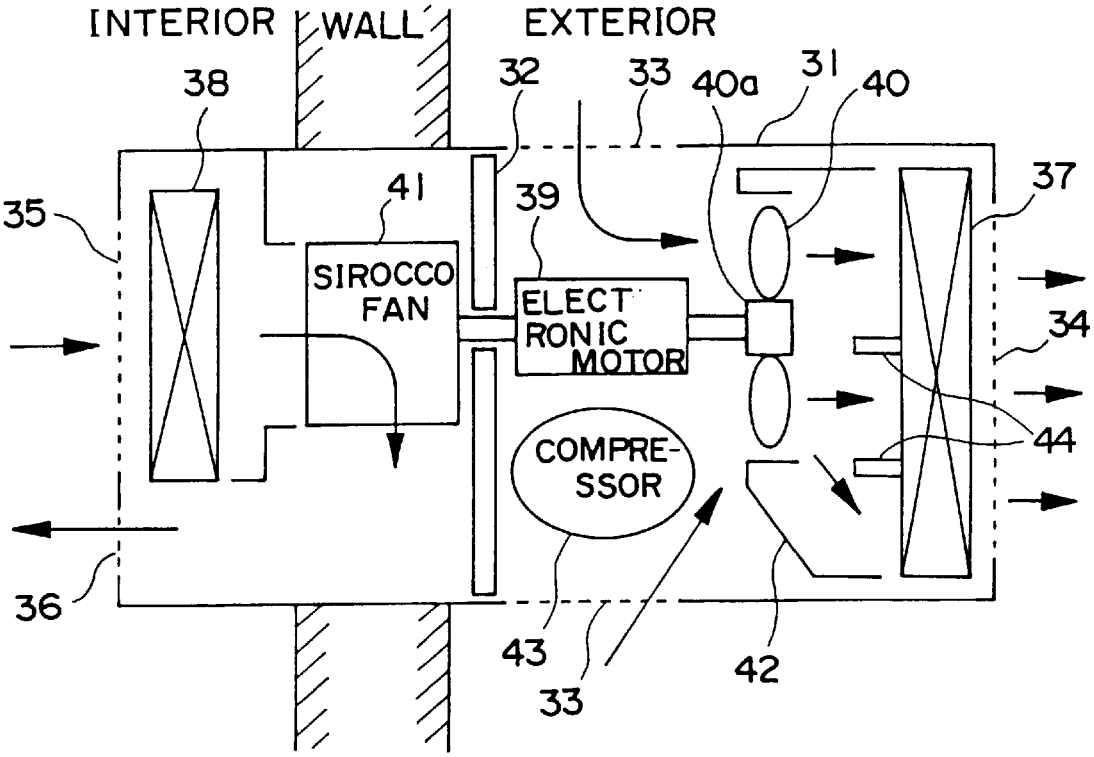
FIG. 12 is a side cross-sectional view showing a window type air conditioner installed on a wall in a fourth embodiment according to the present invention.
Figure 13:
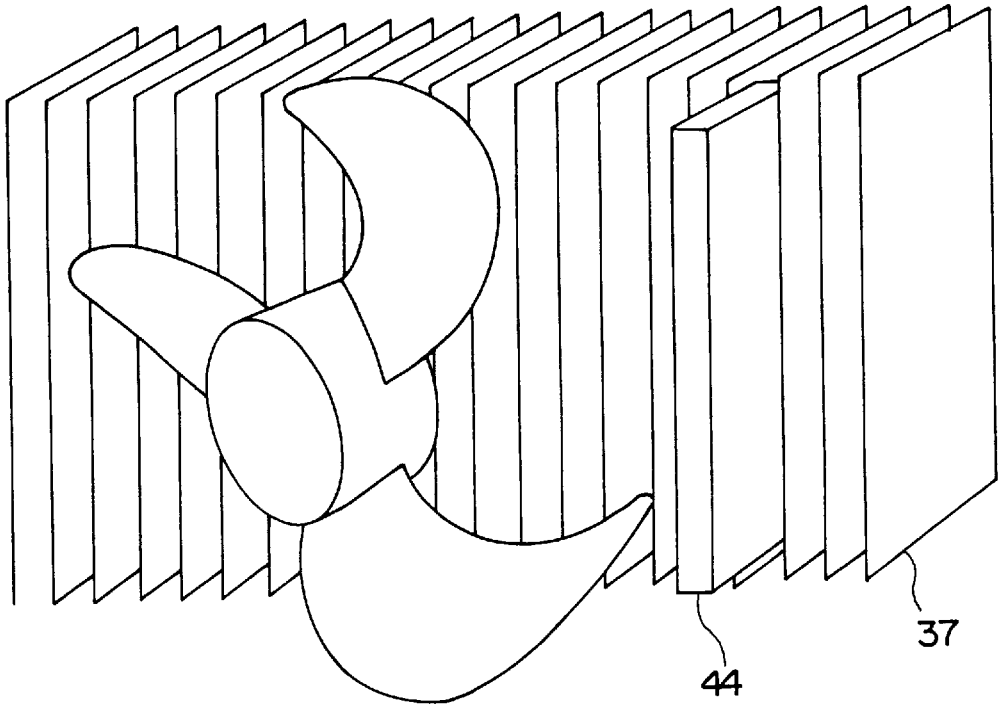
FIG. 13 is a perspective view illustrating the state in which a rectifying plate is installed in the fourth embodiment according to the present invention.
Figure 14:
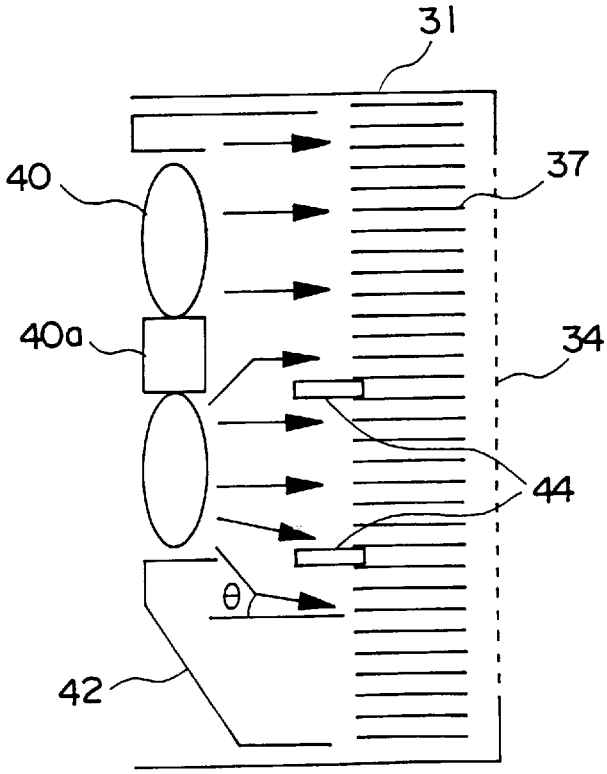
FIG. 14 is a view illustrating an airflow with aid of the rectifying plate in the fourth embodiment according to the present invention.

FIGS. 12 to 14 illustrate a fourth embodiment according to the present invention, in which FIG. 12 is a side cross-sectional view illustrating the state in which a domestic window type air conditioner is installed on a wall; FIG. 13 is a perspective view illustrating the state in which a rectifying plate is fixed; and FIG. 14 is a diagram illustrating an airflow by the rectifying plate.

Here, reference numeral 44 designates a flat rectifying plate which is one example of rectifying means, provided at a suction portion of an exterior heat exchanger 37 in order to reduce an inflowing angle of an inflowing airflow at fin tips of the exterior heat exchanger 37.

The rectifying plate 44 is provided at the suction portion of the exterior heat exchanger 37 except a projection area of an axial fan 40 in order to solve the problem that the inflowing air at the fin tips of the exterior heat exchanger 37 apart from the outer diameter of the axial fan 40 is liable to be separated from the fins due to a large inflowing angle θ between the fins and the inflowing so as to generate noise, in the conventional air conditioner.

Furthermore, since in the conventional air conditioner, no air flows at the rear end 50 of a boss 40*a* of the axial fan 40, the inflowing angle of the inflowing air at the fin tips facing the boss 40*a* also becomes large, so that the inflowing air is liable to be separated from the fins, thereby generating noise. In order to solve the problem experienced in the prior art, a rectifying plate 44 is provided at the suction portion of the exterior heat exchanger 37 within the projection area of the boss 40*a* of the axial fan 40.

In the air conditioner such configured as described above, the axial fan 40 is driven to be rotated by an electric motor 39, so that exterior air is sucked from an exterior suction port 33 into the axial fan 40. In this case, the rectifying plate 44 provided at the suction portion of the exterior heat exchanger 37 except the projection area of the axial fan 40 or at the suction portion of the exterior heat exchanger 37 within the projection area of the boss 40*a* of the axial fan 40, rectifies the inflowing air into the exterior heat exchanger 37 at the fin tips of the exterior heat exchanger 37 in such a manner as to reduce the angle θ between the fin and the inflowing air, and then, allow the inflowing air to be blown out of a blowing-out port 34 through the exterior heat exchanger 37.

In the above-described embodiment, the rectifying plate 44 is provided at the suction portion of the exterior heat exchanger 37 except the projection area of the axial fan 40 or at the suction portion of the exterior heat exchanger 37 within the projection area of the boss 40*a* of the axial fan 40, so that the inflowing air at the fin tips of the exterior heat exchanger 37 is rectified in such a manner as to reduce the angle θ between the fin and the inflowing air, thus producing the effects that the inflowing air is hardly separated. Therefore, noise can be reduced.

Although the present embodiment has been described by way of the example in which the rectifying plates 44 is provided at the suction portion of the exterior heat exchanger 37 except the projection area of the axial fan 40 or at the suction portion of the exterior heat exchanger 37 within the projection area of the boss 40*a* of the axial fan 40, the rectifying plate 44 may be provided at an appropriate position of the suction portion of the exterior heat exchanger 37 as long as the angle θ of the inflowing air can be reduced.

In the above-described fourth embodiment, the workability is not always excellent since the rectifying plate 44 is attached directly to a fin of the exterior heat exchanger 37. However, there is an advantage that the assembling performance of the air conditioner becomes excellent after the rectifying plate 44 is attached.

Although the shape of the rectifying plate 44 is flat in the fourth embodiment, it is not limited to this. For example, the rectifying plate 44 may be formed into such a shape as described below in a fifth embodiment.

Fifth Embodiment

Figure 15:
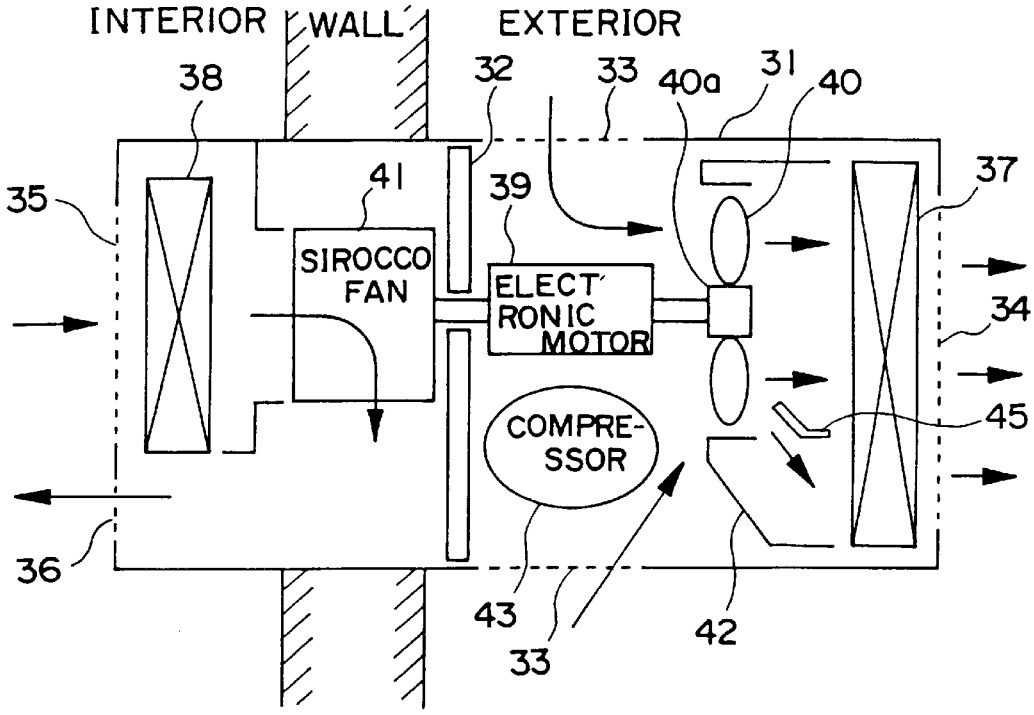
FIG. 15 is a side cross-sectional view showing a window type air conditioner installed on a wall in a fifth embodiment according to the present invention.
Figure 16:
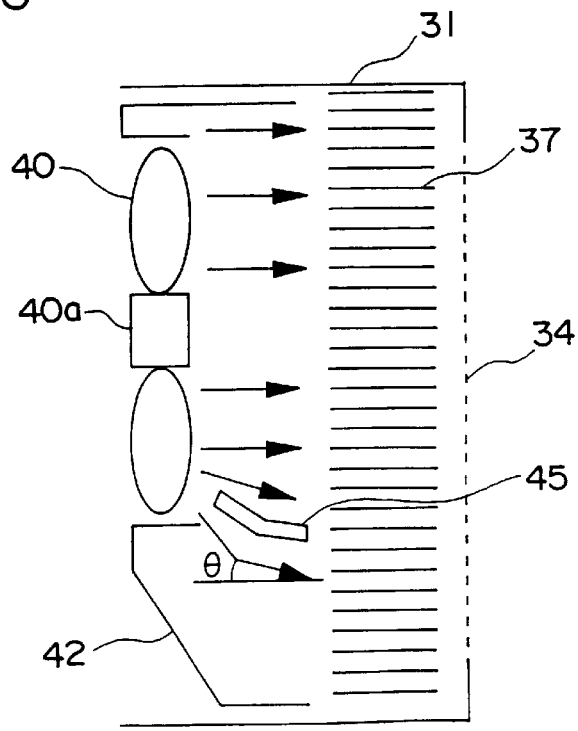
FIG. 16 is a view illustrating an airflow with aid of the rectifying plate in the fifth embodiment according to the present invention.

FIGS. 15 and 16 illustrate a fifth embodiment according to the present invention, in which FIG. 15 is a side cross-sectional view illustrating the state in which a domestic window type air conditioner is installed on a wall; and FIG. 16 is a diagram illustrating an airflow by a rectifying plate.

Here, reference numeral 45 designates the rectifying plate which is one example of rectifying means for reducing an inflowing angle of an inflowing airflow at the fin tips of the exterior heat exchanger 37, the rectifying plate being interposed between an exterior heat exchanger 37 and an axial fan 40, fixed to a portion except the exterior heat exchanger 37, and bent on the suction side thereof toward the axial fan 40.

The rectifying plate 45 is disposed in the vicinity of a suction portion between the axial fan 40 and the exterior heat exchanger 37 except a projection area of the axial fan 40.

Since the rectifying plate 45 is interposed between the exterior heat exchanger 37 and the axial fan 40 but is not fixed to the exterior heat exchanger 37, the rectifying plate 45 need not be fixed to the fins of the exterior heat exchanger 37 so as to enhance fixing workability of the rectifying plate 45, unlike the fourth embodiment.

In the air conditioner such configured as described above, the axial fan 40 is driven to be rotated by an electric motor 39, so that exterior air is sucked from an exterior suction port 33 into the axial fan 40, and then, the rectifying plate 45 rectifies the inflowing airflow in such a manner as to reduce the inflowing angle θ of the inflowing airflow at the fin tips of the exterior heat exchanger 37, and then, allows the inflowing airflow to be blown out of a blowing-out port 34 through the exterior heat exchanger 37.

In the above-described embodiment, the rectifying plate 45 is provided in the vicinity of the suction portion of the exterior heat exchanger 37 except a projection area of the axial fan 40 between the exterior heat exchanger 37 and the axial fan 40, so that the inflowing airflow at the fin tips of the exterior heat exchanger 37 is rectified in such a manner as to reduce the angle θ between the fins and the inflowing airflow, thus producing the effects that the inflowing airflow is hardly separated from the fins and noise can be reduced.

Although the rectifying plate 45 is bent on the suction side thereof toward the axial fan 40 in the present embodiment, it may be formed into a flat shape.

Moreover, the rectifying plate 45 may be disposed in the vicinity of the suction portion of the exterior heat exchanger 37 within the projection area of the boss 40*a* of the axial fan 40 between the exterior heat exchanger 37 and the axial fan 40. Consequently, it is possible to suppress an increase in inflowing angle of the air at the fin tips facing the boss 40*a*, caused by no air flows at the rear end of the boss 40*a* of the axial fin 40.

Sixth Embodiment

Figure 17:
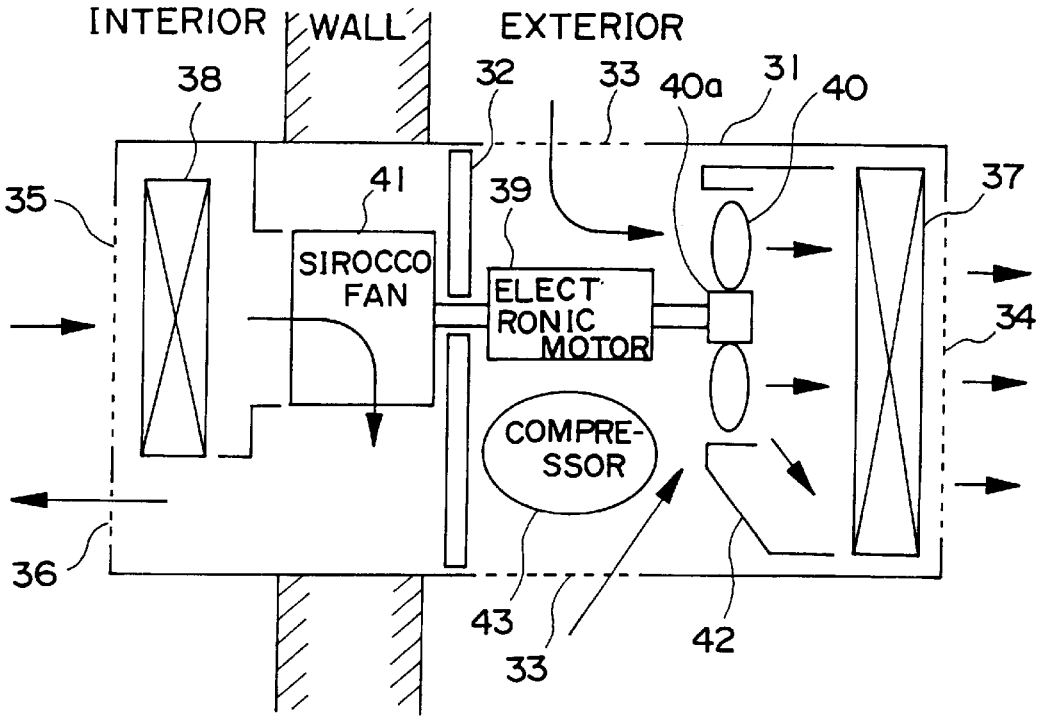
FIG. 17 is a side cross-sectional view showing a window type air conditioner installed on a wall in a sixth embodiment according to the present invention.
Figure 18:
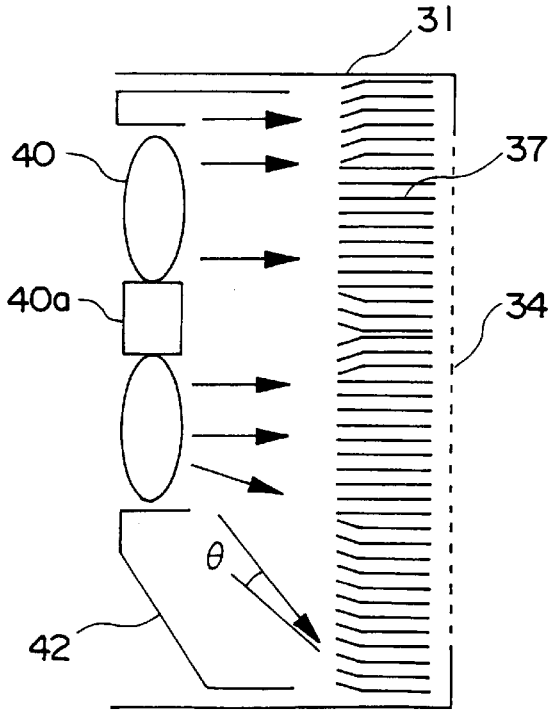
FIG. 18 is a view illustrating an airflow into a heat exchanger in the sixth embodiment according to the present invention.
Figure 19:
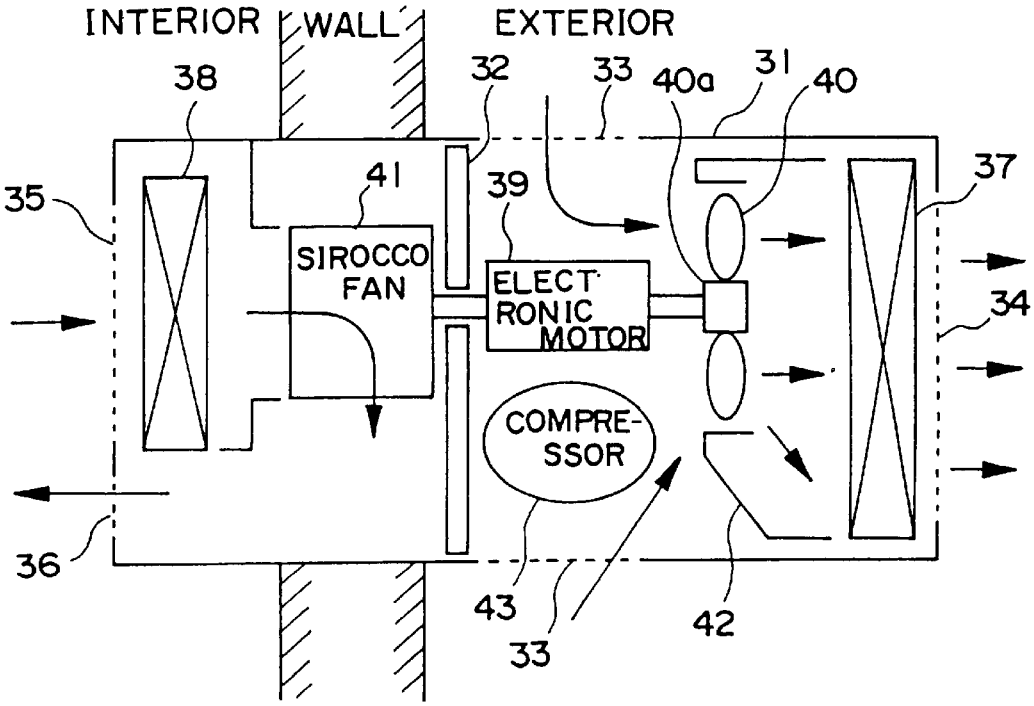
FIG. 19 PRIOR ART
FIG. 19 is a side cross-sectional view showing a conventional window type air conditioner installed on a wall.
Figure 20:
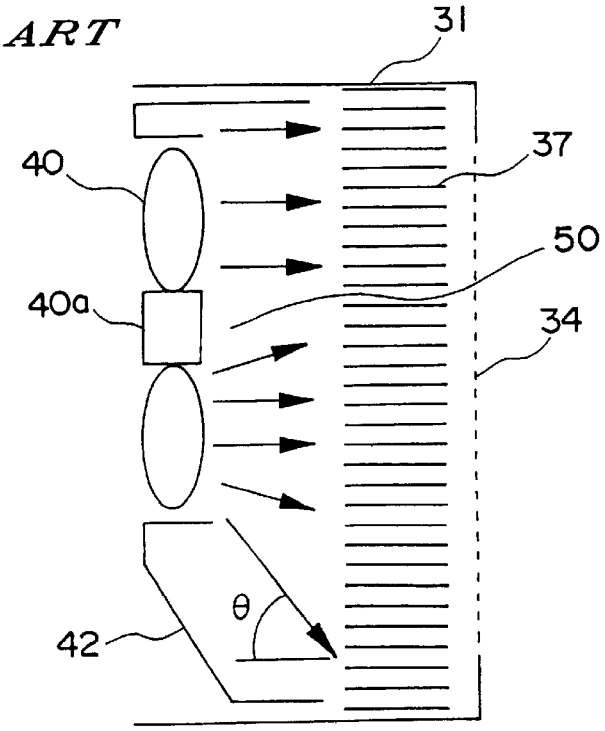
FIG. 20 PRIOR ART
FIG. 20 is a view illustrating an airflow in the conventional window type air conditioner.

FIGS. 17 and 18 illustrate a sixth embodiment according to the present invention, in which FIG. 17 is a side cross-sectional view illustrating the state in which a domestic window type air conditioner is installed on a wall; and FIG. 18 is a diagram illustrating an airflow flowing into a heat exchanger.

Here, as shown in FIG. 18, the fin tips of an exterior heat exchanger 37 at a portion except a projection area of an axial fan 40 are inclined toward the axial fan 40.

In the air conditioner such configured as described above, the axial fan 40 is driven to be rotated by an electric motor 39, so that exterior air is sucked from an exterior suction port 33 into the axial fan 40. Thereafter, since the fin tips of the exterior heat exchanger 37 at the portion except the projection area of the axial fan 40 are inclined toward the axial fan 40, an inflowing airflow is blown out of a blowing-out port 34 without any separation from the exterior heat exchanger 37.

The fin tips of the exterior heat exchanger 37 are inclined toward the axial fan 40, thereby reducing the angle θ between the inflowing airflow and the fin, as shown in FIG. 18.

In the above-described embodiment, it is possible to dispense with the rectifying plate described in the fourth and fifth embodiments, thus reducing the number of component parts.

Additionally, it is possible to eliminate detaching work of the rectifying plate at the time of recycling, and further, the fins are excellent in recycling property since the fins are made of aluminum.

As shown in FIG. 18, it is more effective to incline, toward the blade of the axial fan 40, also the fin tips of the exterior heat exchanger 37 within the projection area of the boss 40*a* of the axial fan 40. The fin tips of the exterior heat exchanger 37 within the projection area of the boss 40*a* are inclined toward the blade of the axial fan 40, thereby suppressing an increase in inflowing angle of the airflow at the fin tips facing the boss 40*a*, caused by no airflow at the rear end of the boss 40*a* of the axial fan 40.

We claim:

1. An air conditioner having an air duct through which temperature-conditioned air reaches a blowing-out port;

a unit box;

said unit box including at least one of a vertical adjusting vane and a lateral adjusting vane;

said air conditioner comprising a rectifying mechanism having an air passage therein provided in said air duct, for rectifying a flow of the conditioned air toward a predetermined flowing direction independent of the positional movement of said at least one lateral adjusting vane and vertical adjusting vane, said rectifying mechanism supplying the conditioned air in a predetermined quantity or more through said air passage and preventing dew condensation along said inner wall of said unit box.

2. An air conditioner according to claim 1 having an air duct through which temperature-conditioned air reaches a blowing-out port, said air conditioner comprising:

a fan positioned in said unit box;

said unit box including lateral adjusting vanes, a blowing-out port, an inner wall surface of a unit box, an upper frame member, and a lower wall; and said rectifying mechanism being mounted in said unit box for unobstructed air flow of conditioned air towards a predetermined flowing direction, wherein said rectifying mechanism provides air flow towards said blowing-out port and prevents dew condensation on said inner wall surface of a unit box.

3. An air conditioner as claimed in claim 2, wherein said rectifying mechanism is disposed in close proximity with at least one of said unit box of air conditioner body, said at least one lateral adjusting vane, said lower wall of unit box, said upper frame member and a nozzle center supporter and is spaced from a guide vane.

4. An air conditioner as claimed in claim 2, wherein said rectifying mechanism is has an air passage formed therein in the form of a duct.

5. An air conditioner as claimed in claim 2, wherein said rectifying mechanism supplies said conditioned air independent of the positional movement of one of said vertical adjusting vanes, said lateral adjusting vanes.

6. An air conditioner as claimed in claim 3, wherein said rectifying mechanism supplies said conditioned air independently of positional movement of one of said vertical adjusting vanes or said lateral adjusting vanes.

7. An air conditioner as claimed in claim 2, wherein said rectifying mechanism comprises a mesh screen for adjusting said air quantity passing through said rectifying mechanism.

8. An air conditioner as claimed in claim 2, wherein said air passage of said rectifying mechanism is positioned at an angle corresponding to a main stream portion of air blowing out said blowing-out port.

9. An air conditioner as claimed in claim 2, wherein said air passage of said rectifying mechanism is positioned so as to deflect said conditioned air in a different direction from the conditioned air entry direction.

10. An air conditioner for providing temperature-conditioned air to reach a blowing-out port, and including at least one of vertical adjusting vanes and lateral adjusting vanes, comprising the following steps:

passing air through an air duct passage of a rectifying mechanism independent of the positional movement of said vertical adjusting vanes and said lateral adjusting vanes; and rectifying the flow of said conditioned air toward in a predetermined flowing direction in a predetermined quantity or more through said air passage for preventing dew condensation along an inner wall of said unit box.

11. An air conditioning process according to claim 10 for providing temperature-conditioned air to reach a blowing-out port, comprising the following steps:

creating air conditioned air by use of a heat exchanger;

blowing said air conditioned with a fan; and passing a portion of said air conditioned air through a rectifying mechanism to a blowing-out port, said air exiting said blow-out port without obstruction.

12. A process as claimed in claim 11 wherein said passing step includes changing the direction of flow of said air conditioned air when passed through said rectifying mechanism.

* * * * *

UNITED STATES PATENT AND TRADEMARK OFFICE
Certificate

Patent No. 6,338,676 B1

Patented: January 15, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Masakazu Kondou, Tokyo, Japan; Jun Kitamura, Tokyo, Japan; Takahiro Murayama, Tokyo, Japan; Motoo Sano, Tokyo, Japan; Shinichi Suzuki, Tokyo, Japan; and Hiroaki Ishikawa, Tokyo, Japan.

Signed and Sealed this Twentieth Day of May 2003.

IRA S. LAZARUS
*Supervisory Patent Examiner*
Art Unit 3749